US007617099B2

(12) United States Patent
Yang et al.

(10) Patent No.: US 7,617,099 B2
(45) Date of Patent: Nov. 10, 2009

(54) NOISE SUPPRESSION BY TWO-CHANNEL TANDEM SPECTRUM MODIFICATION FOR SPEECH SIGNAL IN AN AUTOMOBILE

(75) Inventors: Feng Yang, Plano, TX (US); Huang Yen-Son Paul, Saratoga, CA (US)

(73) Assignee: FortMedia Inc., Cupertino, CA (US)

( * ) Notice: Subject to any disclaimer, the term of this patent is extended or adjusted under 35 U.S.C. 154(b) by 85 days.

(21) Appl. No.: 10/076,120

(22) Filed: Feb. 12, 2002

(65) Prior Publication Data

US 2003/0040908 A1 Feb. 27, 2003

Related U.S. Application Data

(60) Provisional application No. 60/268,403, filed on Feb. 12, 2001.

(51) Int. Cl.
*G10L 21/02* (2006.01)
*G10L 11/02* (2006.01)

(52) U.S. Cl. ..... 704/228; 704/233

(58) Field of Classification Search ..... 704/233, 704/226, 210, 228; 381/71.4
See application file for complete search history.

(56) References Cited

U.S. PATENT DOCUMENTS 5,416,844 A * 5/1995 Nakaji et al. ..... 381/71.4
5,426,703 A * 6/1995 Hamabe et al. ..... 381/71.12
5,610,991 A * 3/1997 Janse ..... 381/92
5,917,919 A * 6/1999 Rosenthal ..... 381/71.11
6,122,610 A * 9/2000 Isabelle ..... 704/226
6,453,285 B1 * 9/2002 Anderson et al. ..... 704/210
6,453,291 B1 * 9/2002 Ashley ..... 704/233
6,754,623 B2 * 6/2004 Deligne et al. ..... 704/233
7,062,049 B1 * 6/2006 Inoue et al. ..... 381/71.4
2002/0152066 A1 * 10/2002 Piket ..... 704/226
2003/0018471 A1 * 1/2003 Cheng et al. ..... 704/233

OTHER PUBLICATIONS

Meyer et al. "Multi-channel speech enhancement in a car environment using wiener filtering and spectral subtraction", Acoustics, Speech, and Signal processing, 1997. ICASSP-97. 1997 IEEE International Conference on, vol. 2, Apr. 21-24, 1997.*

(Continued)

*Primary Examiner*—Talivaldis Ivars Smits
(74) *Attorney, Agent, or Firm*—Thomas, Kayden, Horstemeyer & Risley

(57) ABSTRACT

Techniques for suppressing noise from a signal comprised of speech plus noise. A first signal detector (e.g., a microphone) provides a first signal comprised of a desired component plus an undesired component. A second signal detector (e.g., a sensor) provides a second signal comprised mostly of an undesired component. The adaptive canceller removes a portion of the undesired component in the first signal that is correlated with the undesired component in the second signal and provides an intermediate signal. The voice activity detector provides a control signal indicative of non-active time periods whereby the desired component is detected to be absent from the intermediate signal. The noise suppression unit suppresses the undesired component in the intermediate signal based on a spectrum modification technique and provides an output signal having a substantial portion of the desired component and with a large portion of the undesired component removed.

24 Claims, 8 Drawing Sheets

OTHER PUBLICATIONS

Pollak, Petr and et al. "Noise suppression system for a car," Proc. of the 3rd European Conference on Speech Communication and Technology—EUROSPEECH'93, pp. 1073-1076, Berlin, Germany, Sep. 1993.*

Harrison, W. and et al. "Adaptive noise cancellation in a fighter cockpit environment," Acoustics, Speech, and Signal Processing, IEEE International Conference on ICASSP '84., vol. 9, Mar. 1984. pp. 61-64.*

Boll, Steven. "Suppression of Acoustic Noise in Speech using Spectral Subtraction," IEEE transactions on Acoustics, Speech, and Signal Processing, vol. ASSP-27, No. 2, Apr. 1979. pp. 113-120.*

Coker, Michael , and Simkins, Donald. "A nonlinear adaptive noise canceller," Acoustics, Noise, and Signal Processing, IEEE International Conference on ICASSP '80., vol. 5, Apr. 1980. pp. 470-473.*

Bernard Widrow et al. "Adaptive Noise Cancelling: Principles and Applications", Proc. IEEE, vol. 63, No. 12, Dec. 1975.*

G. Faucon et al. "Optimization of Speech Enhancement Techniques Coping with Uncorrelated or Correlated Noises", Proc. International Conference on Communication Technology 1996, May 1996.*

* cited by examiner

NOISE SUPPRESSION BY TWO-CHANNEL TANDEM SPECTRUM MODIFICATION FOR SPEECH SIGNAL IN AN AUTOMOBILE

BACKGROUND

The present invention relates generally to signal processing. More particularly, it relates to techniques for suppressing noise in a speech signal, which may be used, for example, in an automobile.

In many applications, a speech signal is received in the presence of noise, processed, and transmitted to a far-end party. One example of such a noisy environment is the passenger compartment of an automobile. A microphone may be used to provide hands-free operation for the automobile driver. The hands-free microphone is typically located at a greater distance from the speaking user than with a regular hand-held phone (e.g., the hands-free microphone may be mounted on the dash board or on the overhead visor). The distant microphone would then pick up speech and background noise, which may include vibration noise from the engine and/or road, wind noise, and so on. The background noise degrades the quality of the speech signal transmitted to the far-end party, and degrades the performance of automatic speech recognition device.

One common technique for suppressing noise is the spectral subtraction technique. In a typical implementation of this technique, speech plus noise is received via a single microphone and transformed into a number of frequency bins via a fast Fourier transform (FFT). Under the assumption that the background noise is long-time stationary (in comparison with the speech), a model of the background noise is estimated during time periods of non-speech activity whereby the measured spectral energy of the received signal is attributed to noise. The background noise estimate for each frequency bin is utilized to estimate a signal-to-noise ratio (SNR) of the speech in the bin. Then, each frequency bin is attenuated according to its noise energy content via a respective gain factor computed based on that bin's SNR.

The spectral subtraction technique is generally effective at suppressing stationary noise components. However, due to the time-variant nature of the noisy environment, the models estimated in the conventional manner using a single microphone are likely to differ from actuality. This may result in an output speech signal having a combination of low audible quality, insufficient reduction of the noise, and/or injected artifacts.

As can be seen, techniques that can suppress noise in a speech signal, and which may be used in a noisy environment, particularly in an automobile, are highly desirable.

SUMMARY

The invention provides techniques to suppress noise from a signal comprised of speech plus noise. In accordance with aspects of the invention, two or more signal detectors (e.g., microphones, sensors, and so on) are used to detect respective signals. At least one detected signal comprises a speech component and a noise component, with the magnitude of each component being dependent on various factors. In an embodiment, at least one other detected signal comprises mostly a noise component (e.g., vibration, engine noise, road noise, wind noise, and so on). Signal processing is then used to process the detected signals to generate a desired output signal having predominantly speech, with a large portion of the noise removed. The techniques described herein may be advantageously used in a signal processing system that is installed in an automobile.

An embodiment of the invention provides a signal processing system that includes first and second signal detectors operatively coupled to a signal processor. The first signal detector (e.g., a microphone) provides a first signal comprised of a desired component (e.g., speech) plus an undesired component (e.g., noise), and the second signal detector (e.g., a vibration sensor) provides a second signal comprised mostly of an undesired component (e.g., various types of noise).

In one design, the signal processor includes an adaptive canceller, a voice activity detector, and a noise suppression unit. The adaptive canceller receives the first and second signals, removes a portion of the undesired component in the first signal that is correlated with the undesired component in the second signal, and provides an intermediate signal. The voice activity detector receives the intermediate signal and provides a control signal indicative of non-active time periods whereby the desired component is detected to be absent from the intermediate signal. The noise suppression unit receives the intermediate and second signals, suppresses the undesired component in the intermediate signal based on a spectrum modification technique, and provides an output signal having a substantial portion of the desired component and with a large portion of the undesired component removed. Various designs for the adaptive canceller, voice activity detector, and noise suppression unit are described in detail below.

Another embodiment of the invention provides a voice activity detector for use in a noise suppression system and including a number of processing units. A first unit transforms an input signal (e.g., based on the FFT) to provide a transformed signal comprised of a sequence of blocks of M elements for M frequency bins, one block for each time instant, and wherein M is two or greater (e.g., M=16). A second unit provides a power value for each element of the transformed signal. A third unit receives the power values for the M frequency bins and provides a reference value for each of the M frequency bins, with the reference value for each frequency bin being the smallest power value received within a particular time window for the frequency bin plus a particular offset. A fourth unit compares the power value for each frequency bin against the reference value for the frequency bin and provides a corresponding output value. A fifth unit provides a control signal indicative of activity in the input signal based on the output values for the M frequency bins.

The third unit may be designed to include first and second lowpass filters, a delay line unit, a selection unit, and a summer. The first lowpass filter filters the power values for each frequency bin to provide a respective sequence of first filtered values for that frequency bin. The second lowpass filter similarly filters the power values for each frequency bin to provide a respective sequence of second filtered values for that frequency bin. The bandwidth of the second lowpass filter is wider than that of the first lowpass filter. The delay line unit stores a plurality of first filtered values for each frequency bin. The selection unit selects the smallest first filtered value stored in the delay line unit for each frequency bin. The summer adds the particular offset to the smallest first filtered value for each frequency bin to provide the reference value for that frequency bin. The fourth unit then compares the second filtered value for each frequency bin against the reference value for the frequency bin.

Various other aspects, embodiments, and features of the invention are also provided, as described in further detail below.

The foregoing, together with other aspects of this invention, will become more apparent when referring to the following specification, claims, and accompanying drawings.

DESCRIPTION OF THE SPECIFIC EMBODIMENTS

Figure 1A:
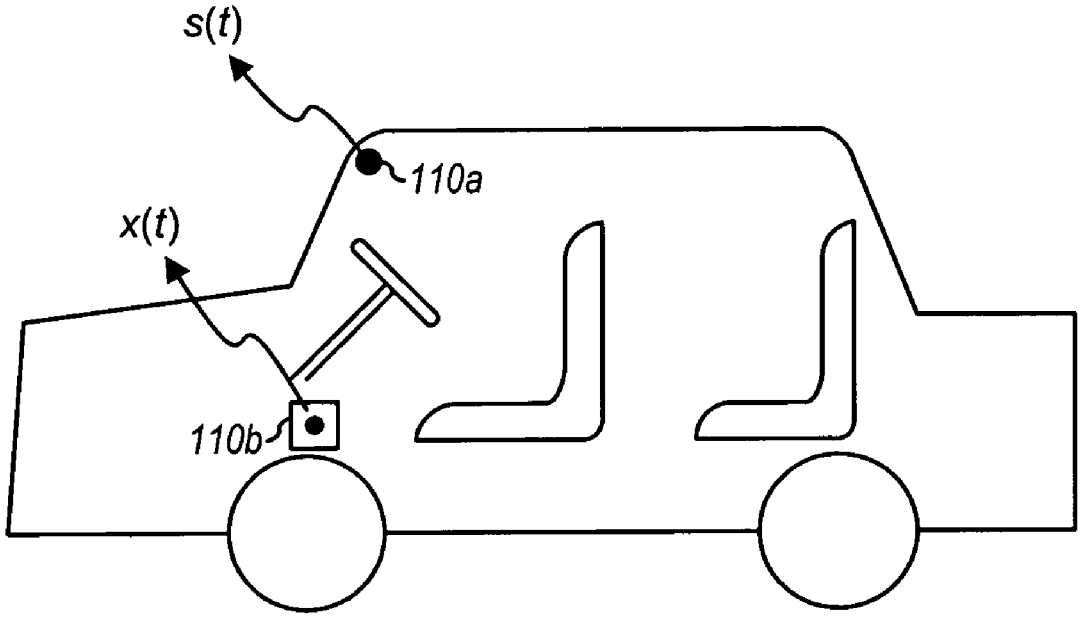
FIG. 1A is a diagram graphically illustrating a deployment of the inventive noise suppression system in an automobile.

FIG. 1A is a diagram graphically illustrating a deployment of the inventive noise suppression system in an automobile. As shown in FIG. 1A, a microphone 110*a* may be placed at a particular location such that it is able to more easily pick up the desired speech from a speaking user (e.g., the automobile driver). For example, microphone 110*a* may be mounted on the dashboard, attached to the steering assembly, mounted on the overhead visor (as shown in FIG. 1A), or otherwise located in proximity to the speaking user. A sensor 110*b* may be used to detect noise to be canceled from the signal detected by microphone 110*a* (e.g., vibration noise from the engine, road noise, wind noise, and other noise). Sensor 110*b* is a reference sensor, and may be a vibration sensor, a microphone, or some other type of sensor. Sensor 110*b* may be located and mounted such that mostly noise is detected, but not speech, to the extent possible.

Figure 1B:
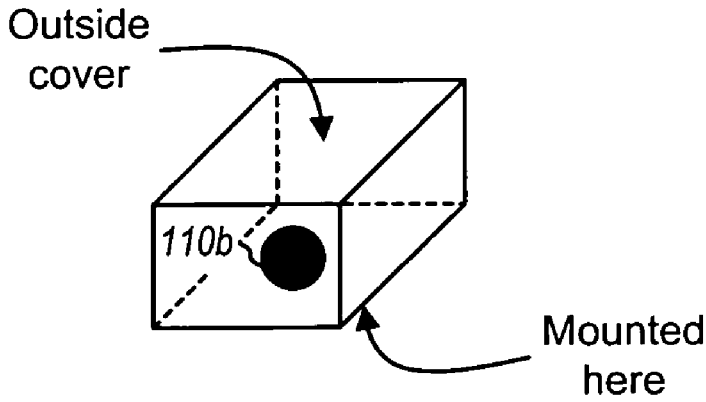
FIG. 1B is a diagram illustrating a sensor.

FIG. 1B is a diagram illustrating sensor 110*b*. If sensor 110*b* is a microphone, then it may be located in a manner to prevent the pick-up of speech signal. For example, microphone sensor 110*b* may be located a particular distance from microphone 110*a* to achieve the pick-up objective, and may further be covered, for example, with a box or some other cover and/or by some absorptive material. For better pick-up of engine vibration and road noise, sensor 110*b* may also be affixed to the chassis of the passenger compartment (e.g., attached to the floor). Sensor 110*b* may also be mounted in other parts of the automobile, for example, on the floor (as shown in FIG. 1A), the door, the dashboard, the trunk, and so on.

Figure 2:
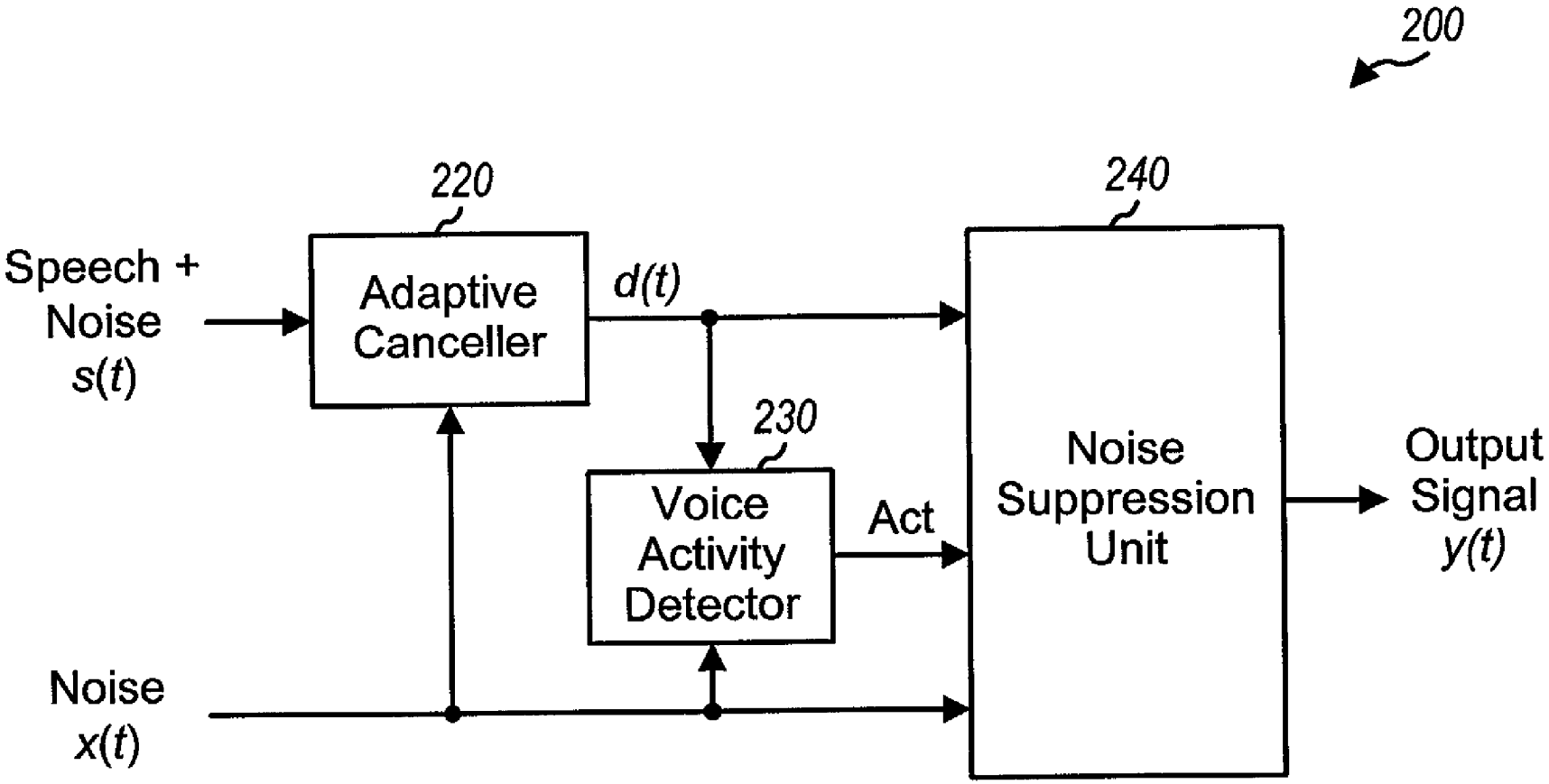
FIG. 2 is a block diagram of an embodiment of a signal processing system capable of suppressing noise from a speech plus noise signal.

FIG. 2 is a block diagram of an embodiment of a signal processing system 200 capable of suppressing noise from a speech plus noise signal. System 200 receives a speech plus noise signal s(t) (e.g., from microphone 110*a*) and a mostly noise signal x(t) (e.g., from sensor 110*b*). The speech plus noise signal s(t) comprises the desired speech from a speaking user (e.g., the automobile driver) plus the undesired noise from the environment (e.g., vibration noise from the engine, road noise, wind noise, and other noise). The mostly noise signal x(t) comprises noise that may or may not be correlated with the noise component to be suppressed from the speech plus noise signal s(t).

Microphone 110*a* and sensor 110*b* provide two respective analog signals, each of which is typically conditioned (e.g., filtered and amplified) and then digitized prior to being subjected to the signal processing by signal processing system 200. For simplicity, this conditioning and digitization circuitry is not shown in FIG. 2

In the embodiment shown in FIG. 2, signal processing system 200 includes an adaptive canceller 220, a voice activity detector (VAD) 230, and a noise suppression unit 240. Adaptive canceller 220 may be used to cancel correlated noise component. Noise suppression unit 240 may be used to suppress uncorrelated noise based on a two-channel spectrum modification technique. Additional processing may further be performed by signal processing system 200 to further suppress stationary noise. These various noise suppression techniques are described in further detail below.

Adaptive canceller 220 receives the speech plus noise signal s(t) and the mostly noise signal x(t), removes the noise component in the signal s(t) that is correlated with the noise component in the signal x(t), and provides an intermediate signal d(t) having speech and some amount of noise. Adaptive canceller 220 may be implemented using various designs, some of which are described below.

Voice activity detector 230 detects for the presence of speech activity in the intermediate signal d(t) and provides an Act control signal that indicates whether or not there is speech activity in the signal s(t). The detection of speech activity may be performed in various manners. One detection technique is described below in FIG. 5. Another detection technique is described by D. K. Freeman et al. in a paper entitled "The Voice Activity Detector for the Pan-European Digital Cellular Mobile Telephone Service," 1989 IEEE International Conference Acoustics, Speech and Signal Processing, Glasgow, Scotland, Mar. 23-26, 1989, pages 369-372, which is incorporated herein by reference.

Noise suppression unit 240 receives and processes the intermediate signal d(t) and the mostly noise signal x(t) to removes noise from the signal d(t), and provides an output signal y(t) that includes the desired speech with a large portion of the noise component suppressed. Noise suppression unit 240 may be designed to implement any one or more of a number of noise suppression techniques for removing noise from the signal d(t). In an embodiment, noise suppression unit 240 implements the spectrum modification technique, which provides good performance and can remove both stationary and non-stationary noise (using a time-varying noise spectrum estimate, as described below). However, other noise suppression techniques may also be used to remove noise, and this is within the scope of the invention.

For some designs, adaptive canceller 220 may be omitted and noise suppression is achieved using only noise suppression unit 240. For some other designs, voice activity detector 230 may be omitted.

The signal processing to suppress noise may be achieved via various schemes, some of which are described below. Moreover, the signal processing may be performed in the time domain or frequency domain.

Figure 3:
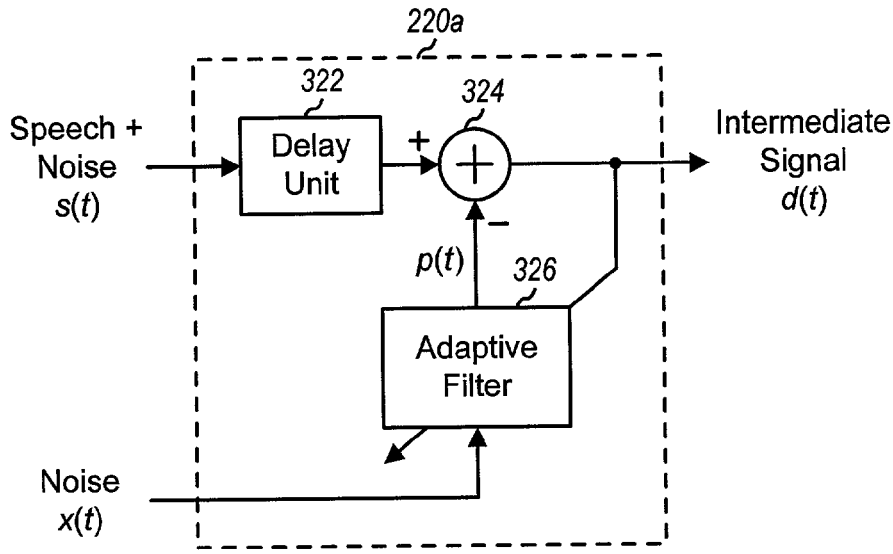
FIG. 3 is a block diagram of an adaptive canceller that performs noise cancellation in the time-domain.

FIG. 3 is a block diagram of an adaptive canceller 220*a*, which is one embodiment of adaptive canceller 220 in FIG. 2. Adaptive canceller 220*a* performs the noise cancellation in the time-domain.

Within adaptive canceller 220*a*, the speech plus noise signal s(t) is delayed by a delay element 322 and then provided to a summer 324. The mostly noise signal x(t) is provided to an adaptive filter 326, which filters this signal with a particular transfer function h(t). The filtered noise signal p(t) is then provided to summer 324 and subtracted from the speech plus noise signal s(t) to provide the intermediate signal d(t) having speech and some amount of noise removed.

Adaptive filter 326 includes a "base" filter operating in conjunction with an adaptation algorithm, both of which are not shown in FIG. 3 for simplicity. The base filter may be implemented as a finite impulse response (FIR) filter, an infinite impulse response (IIR) filter, or some other filter type. The characteristics (i.e., the transfer function) of the base filter is determined by, and may be adjusted by manipulating, the coefficients of the filter. In an embodiment, the base filter is a linear filter, and the filtered noise signal p(t) is a linear function of the mostly noise signal x(t). In other embodiments, the base filter may implement a non-linear transfer function, and this is within the scope of the invention.

The base filter within adaptive filter 326 is adapted to implement (or approximate) the transfer function h(t), which describes the correlation between the noise components in the signals s(t) and x(t). The base filter then filters the mostly noise signal x(t) with the transfer function h(t) to provide the filtered noise signal p(t), which is an estimate of the noise component in the signal s(t). The estimated noise signal p(t) is then subtracted from the speech plus noise signal s(t) by summer 324 to generate the intermediate signal d(t), which is representative of the difference or error between the signals s(t) and p(t). The signal d(t) is then provided to the adaptation algorithm within adaptive filter 326, which then adjusts the transfer function h(t) of the base filter to minimize the error.

The adaptation algorithm may be implemented with any one of a number of algorithms such as a least mean square (LMS) algorithm, a normalized mean square (NLMS), a recursive least square (RLS) algorithm, a direct matrix inversion (DMI) algorithm, or some other algorithm. Each of the LMS, NLMS, RLS, and DMI algorithms (directly or indirectly) attempts to minimize the mean square error (MSE) of the error, which may be expressed as:

$$MSE=E\{|s(t)-p(t)|^2\}, \quad \text{Eq (1)}$$

where $E\{\alpha\}$ is the expected value of $\alpha$, s(t) is the speech plus noise signal (which mainly contains the noise component during the adaptation periods), and p(t) is the estimate of the noise in the signal s(t). In an embodiment, the adaptation algorithm implemented by adaptive filter 326 is the NLMS algorithm.

The NLMS and other algorithms are described in detail by B. Widrow and S.D. Sterns in a book entitled "Adaptive Signal Processing," Prentice-Hall Inc., Englewood Cliffs, N.J., 1986. The LMS, NLMS, RLS, DMI, and other adaptation algorithms are described in further detail by Simon Haykin in a book entitled "Adaptive Filter Theory", 3rd edition, Prentice Hall, 1996. The pertinent sections of these books are incorporated herein by reference.

Figure 4A:
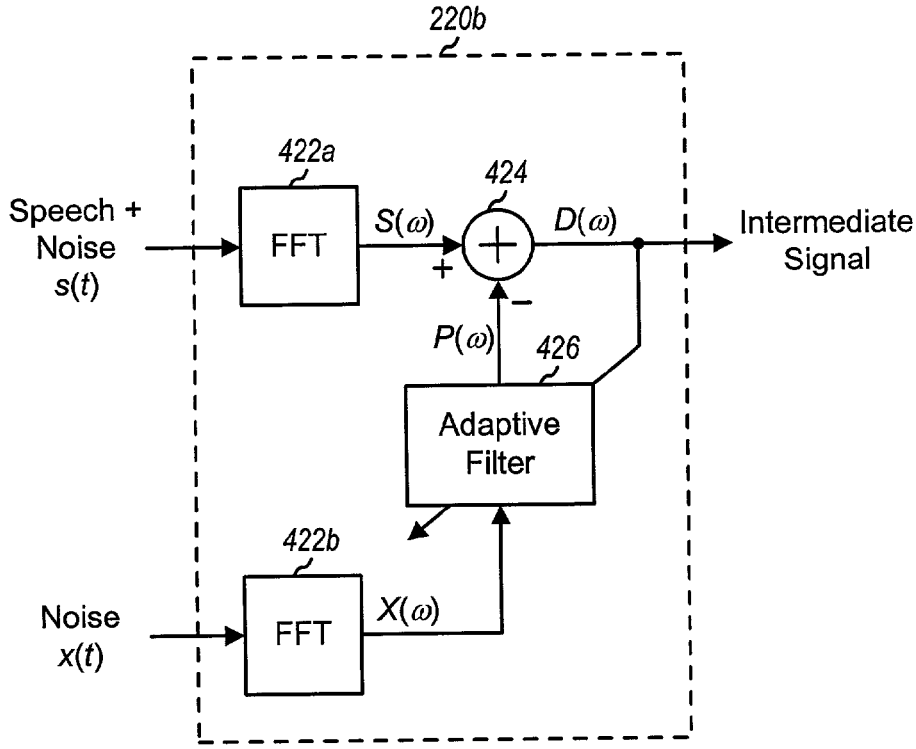
FIGS. 4A and 4B are block diagrams of an adaptive canceller that performs noise cancellation in the frequency-domain.

FIG. 4A is a block diagram of an adaptive canceller 220*b*, which is another embodiment adaptive canceller 220 in FIG. 2. Adaptive canceller 220*b* performs the noise cancellation in the frequency-domain.

Within adaptive canceller 220*b*, the speech plus noise signal s(t) is transformed by a transformer 422*a* to provide a transformed speech plus noise signal S(ω). In an embodiment, the signal s(t) is transformed one block at a time, with each block including L data samples for the signal s(t), to provide a corresponding transformed block. Each transformed block of the signal S(ω) includes L elements, $S_n(\omega_0)$ through $S_n(\omega_{L-1})$, corresponding to L frequency bins, where n denotes the time instant associated with the transformed block. Similarly, the mostly noise signal x(t) is transformed by a transformer 232*b* to provide a transformed noise signal X(ω). Each transformed block of the signal X(ω) also includes L elements, $X_n(\omega_0)$ through $X_n(\omega_{L-1})$.

In the specific embodiment shown in FIG. 4A, transformers 422*a* and 422*b* are each implemented as a fast Fourier transform (FFT) that transforms a time-domain representation into a frequency-domain representation. Other type of transform may also be used, and this is within the scope of the invention. The size of the digitized data block for the signals s(t) and x(t) to be transformed can be selected based on a number of considerations (e.g., computational complexity). In an embodiment, blocks of 128 data samples at the typical audio sampling rate are transformed, although other block sizes may also be used. In an embodiment, the data samples in each block are multiplied by a Hanning window function, and there is a 64-sample overlap between each pair of consecutive blocks.

The transformed speech plus noise signal S(ω) is provided to a summer 424. The transformed noise signal X(ω) is provided to an adaptive filter 426, which filters this noise signal with a particular transfer function H(ω). The filtered noise signal P(ω) is then provided to summer 424 and subtracted from the transformed speech plus noise signal S(ω) to provide the intermediate signal D(ω).

Adaptive filter 426 includes a base filter operating in conjunction with an adaptation algorithm. The adaptation may be achieved, for example, via an NLMS algorithm in the frequency domain. The base filter then filters the transformed noise signal X(ω) with the transfer function H(ω) to provide an estimate of the noise component in the signal S(ω).

Figure 4B:
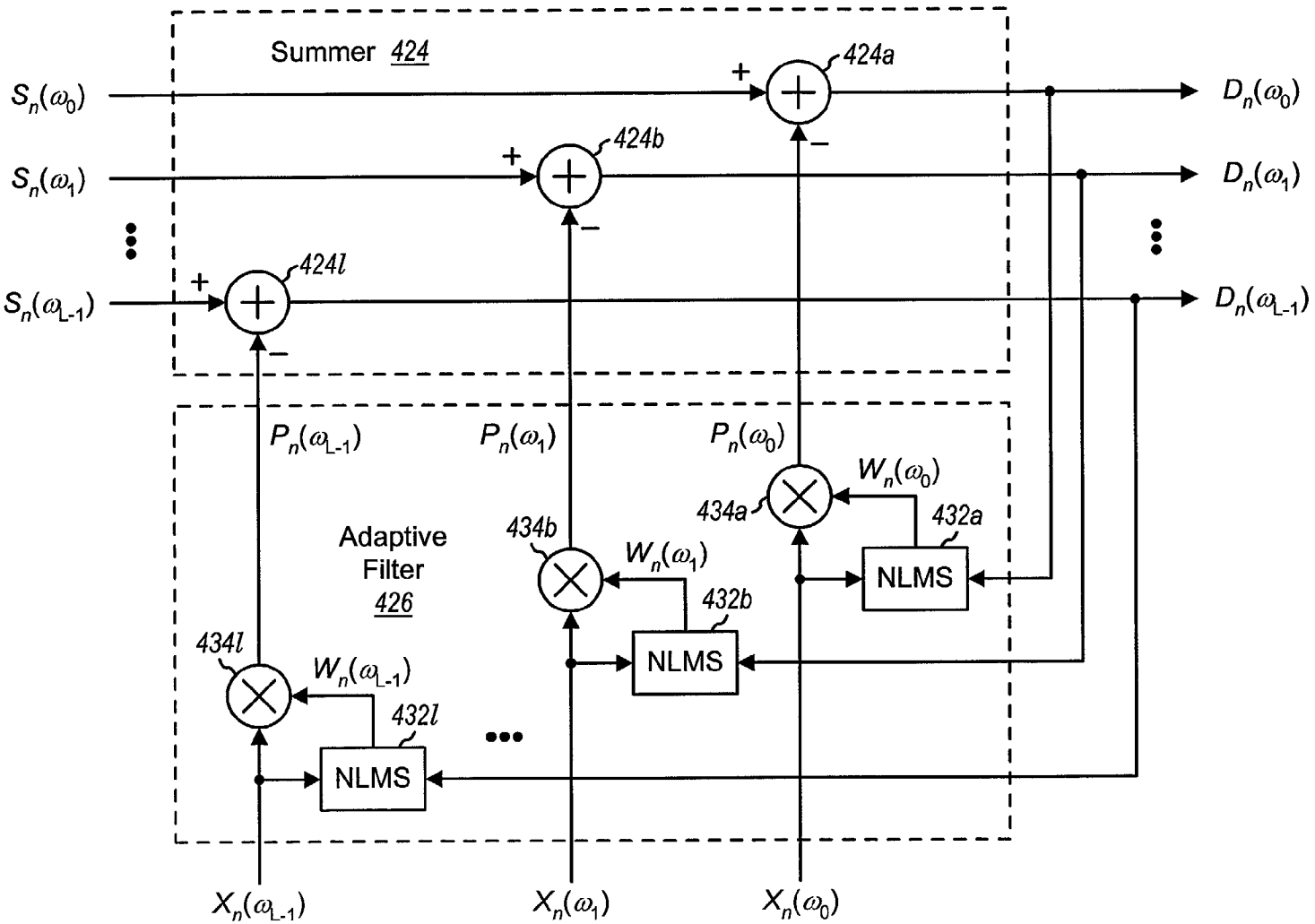

FIG. 4B is a diagram of a specific embodiment of adaptive canceller 220*b*. Within adaptive filter 426, the L transformed noise elements, $X_n(\omega_0)$ through $X_n(\mathbf{107}_{L-1})$, for each transformed block are respectively provided to L complex NLMS units 432*a* through 432*l*, and further respectively provided to L multipliers 434*a* through 434*l*. NLMS units 432*a* through 432*l* further respectively receive the L intermediate elements, $D_n(\omega_0)$ through $D_n(\omega_{L-1})$. Each NLMS unit 432 provides a respective coefficient $W_n(\omega_j)$ for the j-th frequency bin corresponding to that NLMS unit and, when enabled, further updates the coefficient $W_n(\omega_j)$ based on the received elements, $X_n(\omega_j)$ and $D_n(\omega_j)$. Each multiplier 434 multiplies the received noise element $X_n(\omega_j)$ with the coefficient $W_n(\omega_j)$ to provide an estimate $P_n(\omega_j)$ of the noise component in the speech plus noise element $S_n(\omega_j)$ for the j-th frequency bin. The L estimated noise elements, $P_n(\omega_0)$ through $P_n(\omega_{L-1})$, are respectively provided to L summers 424*a* through 424*l*. Each summer 424 subtracts the estimated noise element $P_n(\omega_j)$ from the speech plus noise element $S_n(\omega_j)$ to provide the intermediate element $D_n(\omega_j)$.

NLMS units 432*a* through 432*l* minimize the intermediate elements, $D_n(\omega)$ which represent the error between the estimated noise and the received noise. The estimated noise elements, $P_n(\omega)$ are good approximations of the noise component in the speech plus noise elements $S_n(\omega_j)$. By subtracting the elements $P_n(\omega_j)$ from the elements $S_n(\omega_j)$, the noise component is effectively removed from the speech plus noise elements, and the output elements $D_n(\omega_j)$ would then comprise predominantly the speech component.

Each NLMS unit 432 can be designed to implement the following:

$$W_{n+L}(\omega_j) = W_n(\omega_j) + \mu \cdot \frac{X_n^*(\omega_j) \cdot D_n(\omega_j)}{|X_n(\omega_j)|^2}, \text{ for } j = 0, 1, \ldots, L-1, \quad \text{Eq (2)}$$

where μ is a weighting factor (typically, $0.01<\mu<2.00$) used to determine the convergence rate of the coefficients, and $X_n^*(\omega_j)$ is a complex conjugate of $X_n(\omega_j)$.

The frequency-domain adaptive filter may provide certain advantageous over a time-domain adaptive filter including (1) reduced amount of computation in the frequency domain, (2) more accurate estimate of the gradient due to use of an entire block of data, (3) more rapid convergence by using a normalized step size for each frequency bin, and possibly other benefits.

The noise components in the signals S(ω) and X(ω) may be correlated. The degree of correlation determines the theoretical upper bound on how much noise can be cancelled using a linear adaptive filter such as adaptive filters 326 and 426. If X(ω) and S(ω) are totally correlated, the linear adaptive filter (such as adaptive filters 326 and 426) can cancel the correlated noise components. Since S(ω) and X(ω) are generally not totally correlated, the spectrum modification technique (described below) provide further suppresses the uncorrelated portion of the noise.

Figure 5:
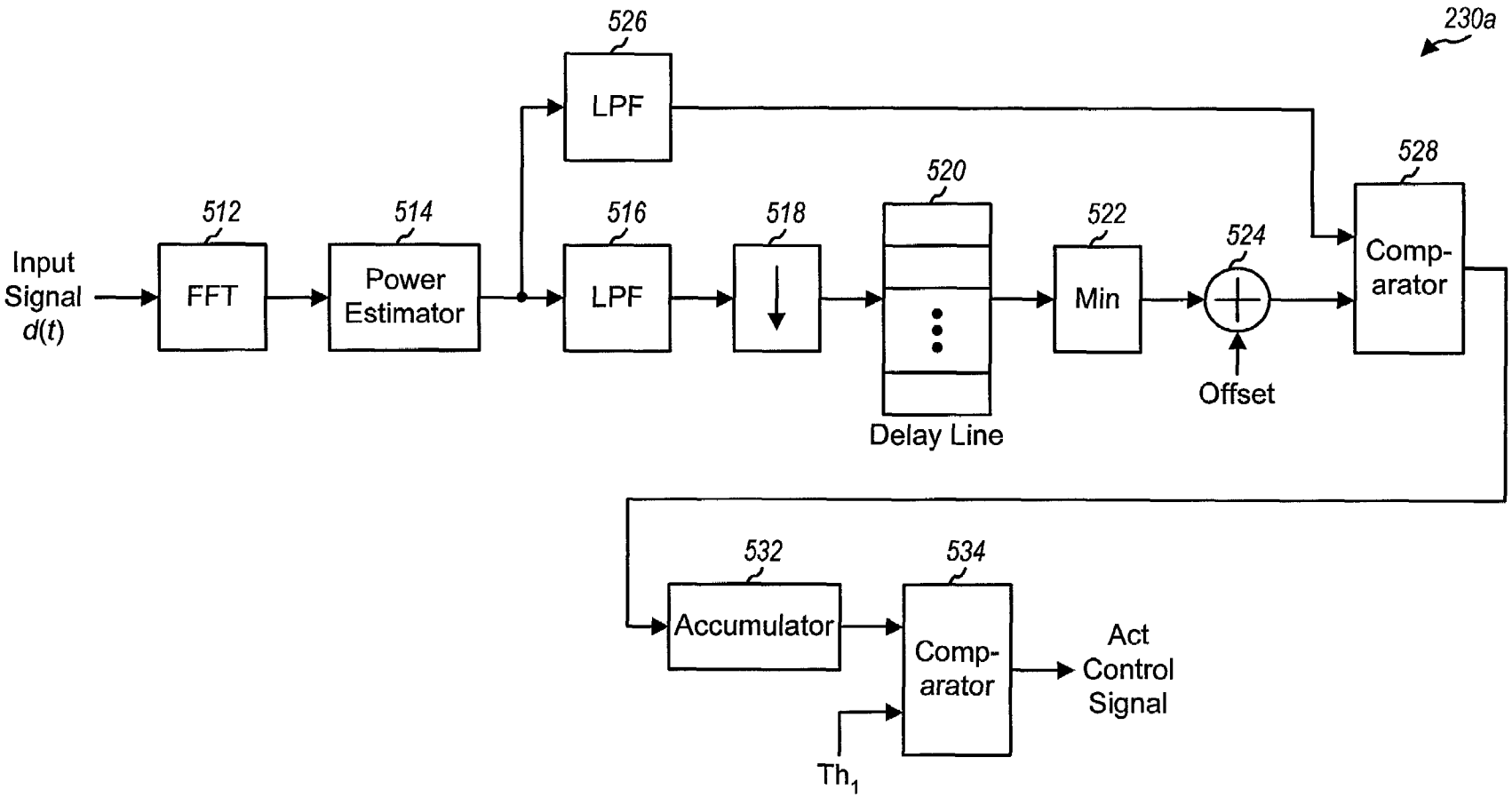
FIG. 5 is a block diagram of an embodiment of a voice activity detector.

FIG. 5 is a block diagram of an embodiment of a voice activity detector 230*a*, which is one embodiment of voice activity detector 230 in FIG. 2. In this embodiment, voice activity detector 230*a* utilizes a multi-frequency band technique to detect the presence of speech in input signal for the voice activity detector, which is the intermediate signal d(t) from adaptive canceller 220.

Within voice activity detector 230*a*, the signal d(t) is provided to an FFT 512, which transforms the signal d(t) into a frequency domain representation. FFT 512 transforms each block of M data samples for the signal d(t) into a corresponding transformed block of M elements, $D_k(\omega_0)$ through $D_k(\omega_{M-1})$, for M frequency bins (or frequency bands). If the signal d(t) has already been transformed into L frequency bins, as described above in FIGS. 4A and 4B, then the power of some of the L frequency bins may be combined to form the M frequency bins, with M being typically much less than L. For example, M can be selected to be 16 or some other value. A bank of filters may also be used instead of FFT 512 to derive M elements for the M frequency bins. A power estimator 514 computes M power values $P_k(\omega_i)$ for each time instant k, which are then provided to lowpass filters (LPFs) 516 and 526.

Lowpass filter 516 filters the power values $P_k(\omega_i)$ for each frequency bin i, and provides the filtered values $F_k^1(\omega_i)$ to a decimator 518, where the superscript "1" denotes the output from lowpass filter 516. The filtering smooth out the variations the power values from power estimator 514. Decimator 518 then reduces the sampling rate of the filtered values $F_k^1(\omega_i)$ for each frequency bin. For example, decimator 518 may retain only one filtered value $F_k^1(\omega_i)$ for each set of $N_D$ filtered values, where each filtered value is further derived from a block of data samples. In an embodiment, $N_D$ may be eight or some other value. The decimated values for each frequency bin are then stored to a respective row of a delay line 520. Delay line 520 provides storage for a particular time duration (e.g., one second) of filtered values $F_k^1(\omega_i)$ for each of the M frequency bins. The decimation by decimator 518 reduces the number of filtered values to be stored in the delay line, and the filtering by lowpass filter 516 removes high frequency components to ensure that aliasing does not occur as a result of the decimation by decimator 518.

Lowpass filter 526 similarly filters the power values $P_k(\omega_i)$ for each frequency bin i, and provides the filtered values $F_k^2(\omega_i)$ to a comparator 528, where the superscript "2" denotes the output from lowpass filter 526. The bandwidth of lowpass filter 526 is wider than that of lowpass filter 516. Lowpass filters 516 and 526 may each be implemented as a FIR filter, an IIR filter, or some other filter design.

For each time instant k, a minimum selection unit 522 evaluates all of the filtered values $F_k^1(\omega_i)$ stored for each frequency bin i and provides the lowest stored value for that frequency bin. For each time instant k, minimum selection unit 522 provides the M smallest values stored for the M frequency bins. Each value provided by minimum selection unit 522 is then added with a particular offset value by a summer 524 to provide a reference value for that frequency bin. The M reference values for the M frequency bins are then provided to a comparator 528.

For each time instant k, comparator 528 receives the M filtered values $F_k^2(\omega_i)$ from lowpass filter 526 and the M reference values from summer 524 for the M frequency bins. For each frequency bin, comparator 528 compares the filtered value $F_k^2(\omega_i)$ against the corresponding reference value and provides a corresponding comparison result. For example, comparator 528 may provide a one ("1") if the filtered value $F_k^2(\omega_i)$ is greater than the corresponding reference value, and a zero ("0") otherwise.

An accumulator 532 receives and accumulates the comparison results from comparator 528. The output of accumulator is indicative of the number of bins having filtered values $F_k^2(\omega_i)$ greater than their corresponding reference values. A comparator 534 then compares the accumulator output against a particular threshold, $Th_1$, and provides the Act control signal based on the result of the comparison. In particular, the Act control signal may be asserted if the accumulator output is greater than the threshold $Th_1$, which indicates the presence of speech activity on the signal d(t), and de-asserted otherwise.

Figure 6:
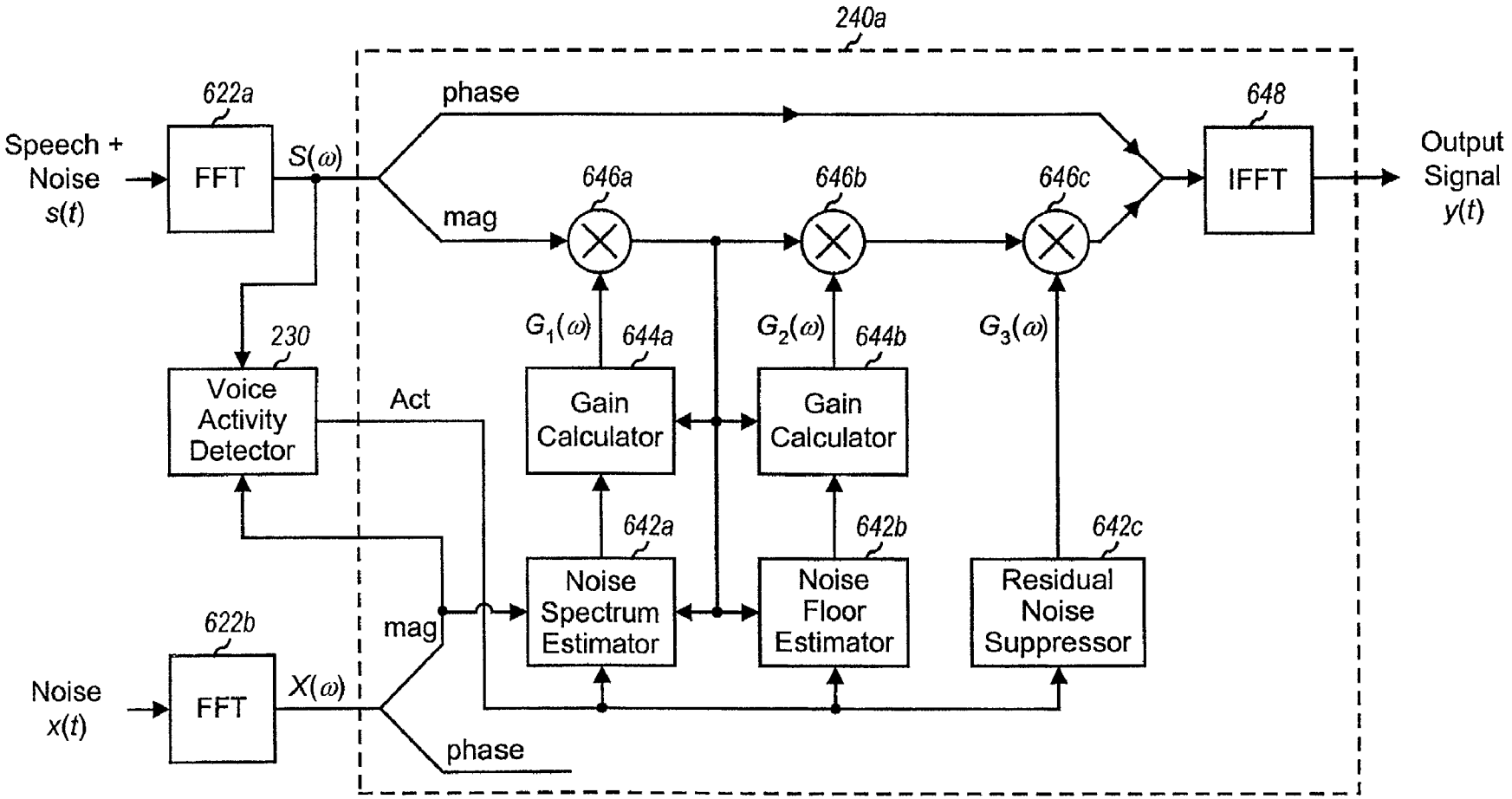
FIG. 6 is a block diagram of an embodiment of a noise suppression unit.

FIG. 6 is a block diagram of an embodiment of a noise suppression unit 240*a*, which is one embodiment of noise suppression unit 240 in FIG. 2. In this embodiment, noise suppression unit 240*a* performs noise suppression in the frequency domain. Frequency domain processing may provide improved noise suppression and may be preferred over time domain processing because of superior performance. The mostly noise signal x(t) does not need to be highly correlated to the noise component in the speech plus noise signal s(t), and only need to be correlated in the power spectrum, which is a much more relaxed criteria.

The speech plus noise signal s(t) is transformed by a transformer 622*a* to provide a transformed speech plus noise signal S(ω). Similarly, the mostly noise signal x(t) is transformed by a transformer 622*b* to provide a transformed mostly noise signal X(ω). In the specific embodiment shown in FIG. 6, transformers 622*a* and 622*b* are each implemented as a fast Fourier transform (FFT). Other type of transform may also be used, and this is within the scope of the invention. For the embodiment in which adaptive canceller 220 performs the noise cancellation in the frequency domain (such as that shown in FIGS. 4A and 4B), transformers 622*a* and 622*b* are not needed since the transformation has already been performed by the adaptive canceller.

It is sometime advantages, although it may not be necessary, to filter the magnitude component of S(ω) and X(ω) so that a better estimation of the short-term spectrum magnitude of the respective signal is obtained. One particular filter implementation is a first-order IIR low-pass filter with different attack and release time.

In the embodiment shown in FIG. 6, noise suppression unit 240*a* includes three noise suppression mechanisms. In particular, a noise spectrum estimator 642*a* and a gain calculation unit 644*a* implement a two-channel spectrum modification technique using the speech plus noise signal s(t) and the mostly noise signal x(t). This noise suppression mechanism may be used to suppress the noise component detected by the sensor (e.g., engine noise, vibration noise, and so on). A noise floor estimator 642*b* and a gain calculation unit 644*b* implement a single-channel spectrum modification technique using only the signal s(t). This noise suppression mechanism may be used to suppress the noise component not detected by the sensor (e.g., wind noise, background noise, and so on). A residual noise suppressor 642*c* implements a spectrum modification technique using only the output from voice activity detector 230. This noise suppression mechanism may be used to further suppress noise in the signal s(t).

Noise spectrum estimator 642*a* receives the magnitude of the transformed signal S(ω), the magnitude of the transformed signal X(ω), and the Act control signal from voice activity detector 230 indicative of periods of non-speech activity. Noise spectrum estimator 642*a* then derives the magnitude spectrum estimates for the noise N(ω), as follows:

$$|N(\omega)|=W(\omega)\cdot|X(\omega)|, \qquad \text{Eq (1)}$$

where W(ω) is referred to as the channel equalization coefficient. In an embodiment, this coefficient may be derived based on an exponential average of the ratio of magnitude of S(ω) to the magnitude of X(ω), as follows:

$$W_{n+1}(\omega) = \alpha W_n(\omega) + (1-\alpha)\frac{|S(\omega)|}{|X(\omega)|}, \qquad \text{Eq (2)}$$

where α is the time constant for the exponential averaging and is $0<\alpha\leqq 1$. In a specific implementation, α=1 when voice activity indicator 230 indicates a speech activity period and α=0.1 when voice activity indicator 230 indicates a non-speech activity period.

Noise spectrum estimator 642*a* provides the magnitude spectrum estimates for the noise N(ω) to gain calculator 644*a*, which then uses these estimates to derive a first set of gain coefficients $G_1(\omega)$ for a multiplier 646*a*.

With the magnitude spectrum of the noise |N(ω)| and the magnitude spectrum of the signal |S(ω)| available, a number of spectrum modification techniques may be used to determine the gain coefficients $G_1(\omega)$. Such spectrum modification techniques include a spectrum subtraction technique, Wiener filtering, and so on.

In an embodiment, the spectrum subtraction technique is used for noise suppression, and gain calculation unit 644*a* determines the gain coefficients $G_1(\omega)$ by first computing the SNR of the speech plus noise signal S(ω) and the noise signal N(ω), as follows:

$$SNR(\omega) = \frac{|S(\omega)|}{|N(\omega)|}. \qquad \text{Eq (5)}$$

The gain coefficient $G_1(\omega)$ for each frequency bin ω may then be expressed as:

$$G_1(\omega) = \max\left(\frac{(SNR(\omega)-1)}{SNR(\omega)}, G_{min}\right), \qquad \text{Eq (6)}$$

where $G_{min}$ is a lower bound on $G_1(\omega)$.

Gain calculation unit 644*a* provides a gain coefficient $G_1(\omega)$ for each frequency bin j of the transformed signal S(ω). The gain coefficients for all frequency bins are provided to multiplier 646*a* and used to scale the magnitude of the signal S(ω).

In an aspect, the spectrum subtraction is performed based on a noise N(ω) that is a time-varying noise spectrum derived from the mostly noise signal x(t). This is different from the spectrum subtraction used in conventional single microphone design whereby N(ω) typically comprises mostly stationary or constant values. This type of noise suppression is also described in U.S. Pat. No. 5,943,429, entitled "Spectral Subtraction Noise Suppression Method," issued Aug. 24, 1999, which is incorporated herein by reference. The use of a time-varying noise spectrum (which more accurately reflects the real noise in the environment) allows for the cancellation of non-stationary noise as well as stationary noise (non-stationary noise cancellation typically cannot be achieve by conventional noise suppression techniques that use a static noise spectrum).

Noise floor estimator 642*b* receives the magnitude of the transformed signal S(ω) and the Act control signal from voice activity detector 230. Noise floor estimator 642*b* then derives the magnitude spectrum estimates for the noise N(ω), as shown in equation (4), during periods of non-speech, as indicated by the Act control signal from voice activity indicator 230. For the single-channel spectrum modification technique, the same signal S(ω) is used to derive the magnitude spectrum estimates for both the speech and the noise.

Gain calculation unit 644*b* then derives a second set of gain coefficients $G_2(\omega)$ by first computing the SNR of the speech component in the signal S(ω) and the noise component in the signal S(ω), as shown in equation (6). Gain calculation unit 644*b* then determines the gain coefficients $G_2(\omega)$ based on the computed SNRs, as shown in equation(6).

The spectrum subtraction technique for a single channel is also described by S. F. Boll in a paper entitled "Suppression of Acoustic Noise in Speech Using Spectral Subtraction," IEEE Trans. Acoustic Speech Signal Proc., April 1979, vol. ASSP-27, pp. 113-121, which is incorporated herein by reference.

Noise floor estimator 642*b* and gain calculation unit 644*b* may also be designed to implement a two-channel spectrum modification technique using the speech plus noise signal s(t) and another mostly noise signal that may be derived by another sensor/microphone or a microphone array. The use of a microphone array to derive the signals s(t) and x(t) is described in detail in copending U.S. patent application Ser. No. 10/076,201, entitled "Noise Suppression for a Wireless Communication Device," filed Feb. 12, 2002, assigned to the assignee of the present application and incorporated herein by reference.

Residual noise suppressor 642*c* receives the Act control signal from voice activity detector 230 and provides a third set of gain coefficients $G_3(\omega)$. In an embodiment, the gain coefficients $G_3(\omega)$ for each frequency bin ω may be expressed as:

$$G_3(\omega) = \begin{cases} 1 & \text{for } Act = 1 \\ G_a & \text{for } Act = 0 \end{cases}, \quad \text{Eq (7)}$$

where $G_{60}$ is a particular value and may be selected as $0 \leqq G_\alpha \leqq 1$.

As shown in FIG. 6, multiplier 646*a* receives and scales the magnitude component of S(ω) with the first set of gain coefficients $G_1(\omega)$ provided by gain calculation unit 644*a*. The scaled magnitude component from multiplier 646*a* is then provided to a multiplier 646*b* and scaled with the second set of gain coefficients $G_2(\omega)$ provided by gain calculation unit 644*b*. The scaled magnitude component from multiplier 646*b* is further provided to a multiplier 646*c* and scaled with the third set of gain coefficients $G_3(\omega)$ provided by residual noise suppressor 642*c*. Alternatively, the three sets of gain coefficients may be combined to provide one set of composite gain coefficients, which may then be used to scale the magnitude component of S(ω).

In the embodiment shown in FIG. 6, multiplier 646*a*, 646*b*, and 646*c* are arranged in a serial configuration. This represents one way of combining the multiple gains computed by different noise suppression units. Other ways of combining multiple gains are also possible, and this is within the scope of this application. For example, the total gain for each frequency bin may be selected as the minimum of all gain coefficients for that frequency bin.

In any case, the scaled magnitude component of S(ω) is recombined with the phase component of S(ω) and provided to an inverse FFT (IFFT) 648, which transforms the recombined signal back to the time domain. The resultant output signal y(t) includes predominantly speech and has a large portion of the background noise removed.

The embodiment shown in FIG. 6 employ three different noise suppression mechanisms to provide improved performance. For other embodiments, one or more of these noise suppression mechanisms may be omitted. For example, a noise suppression unit 240 may be designed without the single-channel spectrum modification technique implemented by noise floor estimator 642*b*, gain calculation unit 644*b*, and multiplier 646*b*. As another example, a noise suppression unit 230 may be designed without the noise suppression by residual noise suppressor 642*c* and multiplier 646*c*.

The spectrum modification technique is one technique for removing noise from the speech plus noise signal s(t). The spectrum modification technique provides good performance and can remove both stationary and non-stationary noise (using the time-varying noise spectrum estimate described above). However, other noise suppression techniques may also be used to remove noise, and this is within the scope of the invention.

Figure 7:
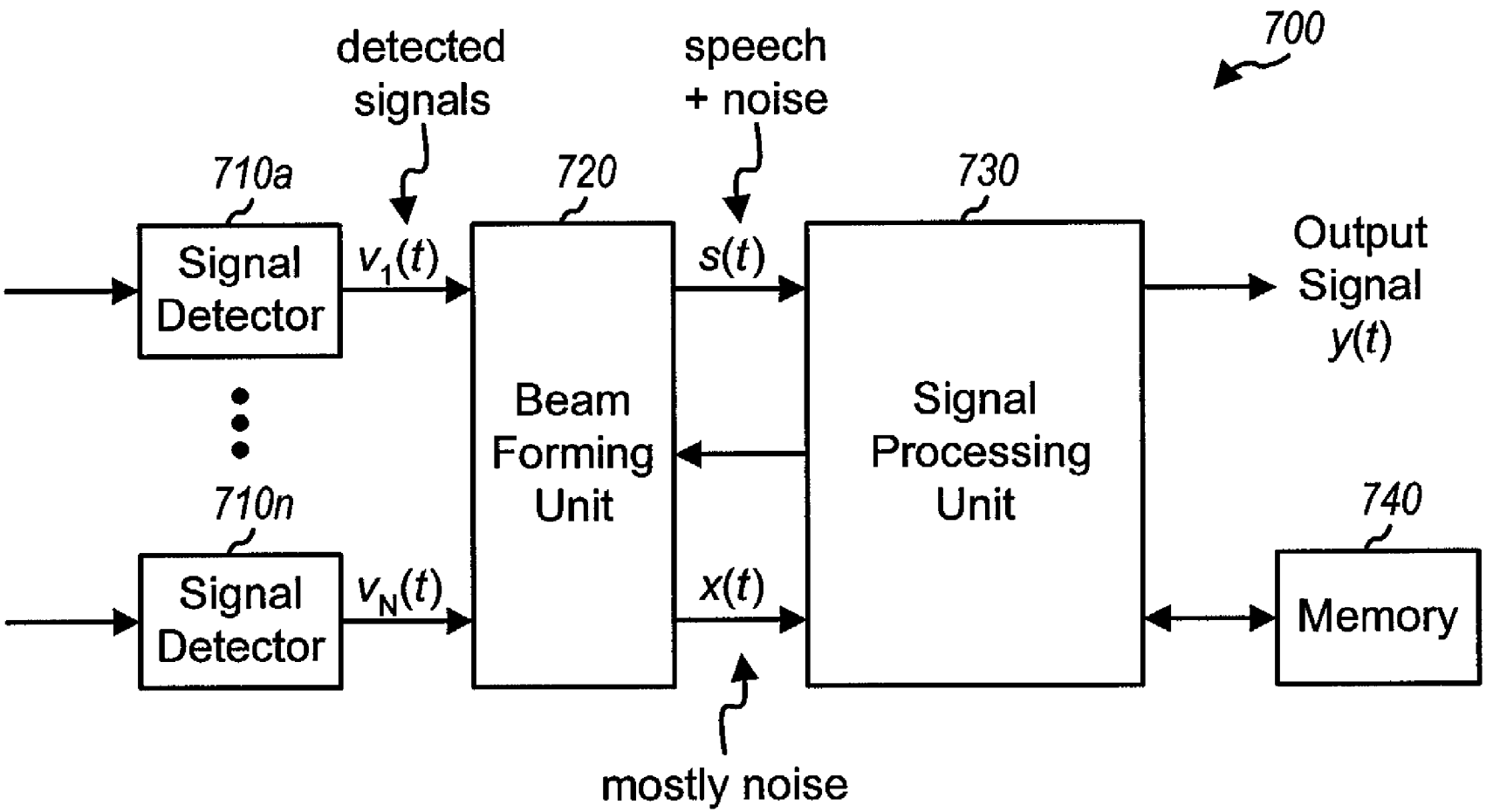
FIG. 7 is a block diagram of a signal processing system capable of removing noise from a speech plus noise signal and utilizing a number of signal detectors, in accordance with yet another embodiment of the invention.

FIG. 7 is a block diagram of a signal processing system 700 capable of removing noise from a speech plus noise signal and utilizing a number of signal detectors, in accordance with yet another embodiment of the invention. System 700 includes a number of signal detectors 710*a* through 710*n*. At least one signal detector 710 is designated and configured to detect speech, and at least one signal detector is designated and configured to detect noise. Each signal detector may be a microphone, a sensor, or some other type of detector. Each signal detector provides a respective detected signal v(t).

Signal processing system 700 further includes an adaptive beam forming unit 720 coupled to a signal processing unit 730. Beam forming unit 720 processes the signals v(t) from signal detectors 710*a* through 710*n* to provide (1) a signal s(t) comprised of speech plus noise and (2) a signal x(t) comprised of mostly noise. Beam forming unit 720 may be implemented with a main beam former and a blocking beam former.

The main beam former combines the detected signals from all or a subset of the signal detectors to provide the speech plus noise signal s(t). The main beam former may be implemented with various designs. One such design is described in detail in the aforementioned U.S. patent application Ser. No. 10/076,201.

The blocking beam former combines the detected signals from all or a subset of the signal detectors to provide the mostly noise signal x(t). The blocking beam former may also be implemented with various designs. One such design is described in detail in the aforementioned U.S. patent application Ser. No. 10/076,201.

Beam forming techniques are also described in further detail by Bernal Widrow et al., in "Adaptive Signal Processing," Prentice Hall, 1985, pages 412-419, which is incorporated herein by reference.

The speech plus noise signal s(t) and the mostly noise signal x(t) from beam forming unit 720 are provided to signal processing unit 730. Beam forming unit 720 may be incorporated within signal processing unit 730. Signal processing unit 730 may be implemented based on the design for signal processing system 200 in FIG. 2 or some other design. In an embodiment, signal processing unit 730 further provides a control signal used to adjust the beam former coefficients, which are used to combine the detected signals v(t) from the signal detectors to derive the signals s(t) and x(t).

Figure 8:
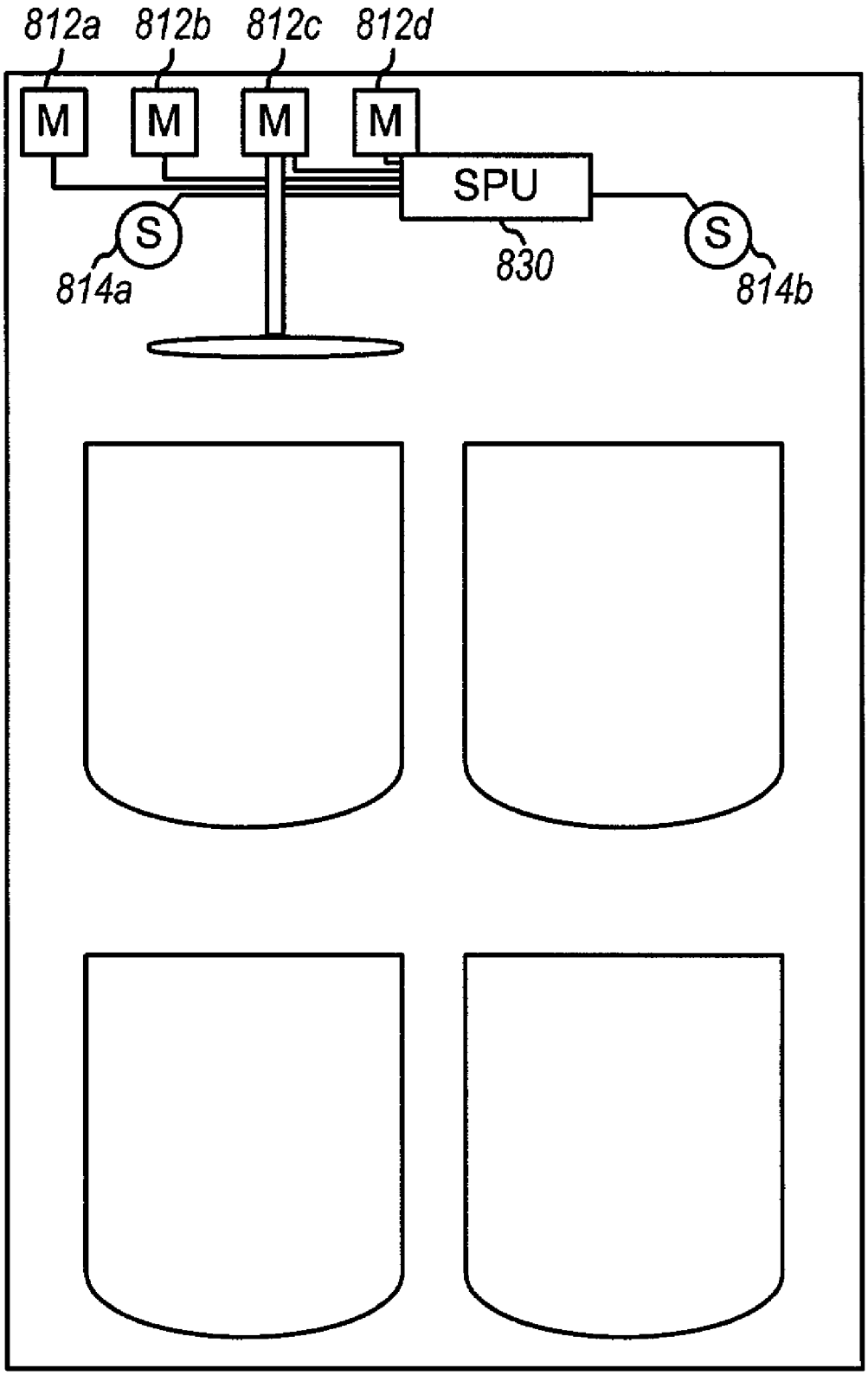
FIG. 8 is a diagram illustrating the placement of various elements of a signal processing system within a passenger compartment of an automobile.

FIG. 8 is a diagram illustrating the placement of various elements of a signal processing system within a passenger compartment of an automobile. As shown in FIG. 8, microphones 812*a* through 812*d* may be placed in an array in front of the driver (e.g., along the overhead visor or dashboard). Depending on the design, any number of microphones may be used. These microphones may be designated and configured to detect speech. Detection of mostly speech may be achieved by various means such as, for example, by (1) locating the microphone in the direction of the speech source (e.g., in front of the speaking user), (2) using a directional microphone, such as a dipole microphone capable of picking up signal from the front and back but not the side of the microphone, and so on.

One or more microphones may also be used to detect background noise. Detection of mostly noise may be achieved by various means such as, for example, by (1) locating the microphone in a distant and/or isolated location, (2) covering the microphone with a particular material, and so on. One or more signal sensors 814 may also be used to detect various types of noise such as vibration, engine noise, motion, wind noise, and so on. Better noise pick up may be achieved by affixing the sensor to the chassis of the automobile.

Microphones 812 and sensors 814 are coupled to a signal processing unit 830, which can be mounted anywhere within or outside the passenger compartment (e.g., in the trunk). Signal processing unit 830 may be implemented based on the designs described above in FIGS. 2 and 7 or some other design.

The noise suppression described herein provides an output signal having improved characteristics. In an automobile, a large amount of noise is derived from vibration due to road, engine, and other sources, which dominantly are low frequency noise that is especially difficult to suppress using conventional techniques. With the reference sensor to detect the vibration, a large portion of the noise may be removed from the signal, which improves the quality of the output signal. The techniques described herein allows a user to talk softly even in a noisy environment, which is highly desirable.

For simplicity, the signal processing systems described above use microphones as signal detectors. Other types of signal detectors may also be used to detect the desired and undesired components. For example, vibration sensors may be used to detect car body vibration, road noise, engine noise, and so on.

For clarity, the signal processing systems have been described for the processing of speech. In general, these systems may be used process any signal having a desired component and an undesired component.

The signal processing systems and techniques described herein may be implemented in various manners. For example, these systems and techniques may be implemented in hardware, software, or a combination thereof. For a hardware implementation, the signal processing elements (e.g., the beam forming unit, signal processing unit, and so on) may be implemented within one or more application specific integrated circuits (ASICs), digital signal processors (DSPs), programmable logic devices (PLDs), controllers, microcontrollers, microprocessors, other electronic units designed to perform the functions described herein, or a combination thereof. For a software implementation, the signal processing systems and techniques may be implemented with modules (e.g., procedures, functions, and so on) that perform the functions described herein. The software codes may be stored in a memory unit (e.g., memory 830 in FIG. 8) and executed by a processor (e.g., signal processor 830). The memory unit may be implemented within the processor or external to the processor, in which case it can be communicatively coupled to the processor via various means as is known in the art.

The foregoing description of the specific embodiments is provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein, and as defined by the following claims.

What is claimed is:

1. A signal processing system used in automobile to suppress noise from a speech signal comprising:

a first signal detector configured to provide a first signal comprised of a desired component plus an undesired component, wherein the desired component includes speech;

a second signal detector configured to provide a second signal comprised mostly of an undesired component; and a signal processor operatively coupled to the first and second signal detectors and comprising a first noise suppression unit configured to process the first and second signals based on a two-channel spectrum modification technique to suppress the undesired component in the first signal, and a second noise suppression unit configured to suppress the undesired component in the first signal based on a single-channel spectrum modification technique.

2. The system of claim 1, wherein the desired component in the first signal is speech.

3. The system of claim 1, wherein the first signal detector is a microphone configured to detect speech.

4. The system of claim 1, wherein the second signal detector is a sensor configured to detect automobile vibration.

5. The system of claim 1, wherein the second signal detector is a sensor configured to detect mostly noise.

6. The system of claim 1, wherein the signal processor further comprises:

an adaptive canceller configured to process the first and second signals in accordance with a set of coefficients for a cancellation technique, to provide an intermediate signal having a portion of the undesired component in the first signal that is correlated with the undesired component in the second signal removed, and to adjust the set of coefficients using the intermediate signal.

7. The system of claim 6, wherein the adaptive canceller implements a normalized least mean square (NLMS) algorithm.

8. The system of claim 6, wherein the adaptive canceller is implemented in a time domain.

9. The system of claim 6, wherein the adaptive canceller is implemented in a frequency domain.

10. The system of claim 6, wherein the signal processor further includes a voice activity detector configured to receive the intermediate signal from the adaptive canceller and provide a control signal indicative of non-active time periods whereby the desired component is detected to be absent from the intermediate signal.

11. The system of claim 1, wherein the signal processor further comprises:

a third noise suppression unit configured to suppress residual undesired component in the first signal based on a status of a voice activity detector.

12. The system of claim 1, wherein the first noise suppression unit is configured to suppress the undesired component in the first signal in a frequency domain.

13. The system of claim 1 and configured for installation in an automobile.

14. A signal processing system used in automobile to suppress noise from a speech signal comprising:

a first signal detector configured to provide a first signal comprised of a desired component plus an undesired component, wherein the desired component includes speech;

a second signal detector configured to provide a second signal comprised mostly of an undesired component; and a signal processor operatively coupled to the first and second signal detectors and comprising a first noise suppression unit configured to process the first and second signals based on a two-channel spectrum modification technique to suppress the undesired component in the first signal, and a second noise suppression unit configured to suppress residual undesired component in the first signal.

15. The system of claim 14, further comprises:

an adaptive canceller configured to receive and process the first and second signals, to suppress a portion of the undesired component in the first signal that is correlated with the undesired component in the second signal, and to provide an intermediate signal; and a voice activity detector configured to receive the intermediate signal and provide a control signal indicative of non-active time periods whereby the desired component is detected to be absent from the intermediate signal.

16. The system of claim 15, wherein the adaptive canceller is configured to adaptively cancel the correlated portion of the undesired component based on a linear transfer function.

17. The system of claim 15, wherein the adaptive canceller is configured to adaptively cancel the correlated portion of the undesired component based on a non-linear transfer function.

18. The system of claim 15, wherein the first noise suppression unit includes a noise spectrum estimator configured to receive the intermediate and second signals and provide spectrum estimates of the desired component in the intermediate signal and the undesired component in the second signal, a gain calculation unit configured to receive the spectrum estimates and provide a set of gain coefficients, and a multiplier configured to multiply magnitude of a transformed intermediate signal with the set of gain coefficients.

19. The system of claim 15, wherein the signal processor further comprises a third noise suppression unit configured to suppress the undesired component in the intermediate signal based on a single-channel spectrum modification technique using the intermediate signal.

20. The system of claim 19, wherein the third noise suppression unit includes a noise spectrum estimator configured to receive the intermediate signal and provide spectrum estimates of the undesired component and the desired component in the intermediate signal, a gain calculation unit configured to receive the spectrum estimates and provide a set of gain coefficients, and a multiplier configured to multiply magnitude of a transformed intermediate signal with the set of gain coefficients.

21. The system of claim 15, wherein the second noise suppression unit includes a noise suppressor configured to receive the control signal from the voice activity detector and provide a set of gain coefficients, and a multiplier configured to multiply magnitude of a transformed intermediate signal with the set of gain coefficients.

22. The system of claim 15 and configured for installation in an automobile.

23. A method for suppressing noise in an automobile, comprising:

detecting via a first signal detector a first signal comprised of a desired component plus an undesired component;

detecting via a second signal detector a second signal comprised mostly of an undesired component;

processing the first and second signals based on a two-channel spectrum modification technique to suppress the undesired component in the first signal; and suppressing the undesired component in the first signal based on a single-channel spectrum modification technique.

24. A method for suppressing noise in an automobile, comprising:

detecting via a first signal detector a first signal comprised of a desired component plus an undesired component;

detecting via a second signal detector a second signal comprised mostly of an undesired component;

processing the first and second signals based on a two-channel spectrum modification technique to suppress the undesired component in the first signal; and suppressing residual undesired component in the first signal.

* * * * *